US009324236B2

(12) United States Patent
Estkowski et al.

(10) Patent No.: US 9,324,236 B2
(45) Date of Patent: Apr. 26, 2016

(54) SYSTEM AND METHODS FOR SITUATION AWARENESS, ADVISORY, TRACKING, AND AIRCRAFT CONTROL INFORMATION

(75) Inventors: Regina I. Estkowski, Bellevue, WA (US); Ted Dell Whitley, Lopez Island, WA (US); Richard Baumeister, Aurora, CO (US); Graham Spence, Huddersfield (GB)

(73) Assignee: The Boeing Company, Chicago, IL (US)

( * ) Notice: Subject to any disclaimer, the term of this patent is extended or adjusted under 35 U.S.C. 154(b) by 689 days.

(21) Appl. No.: 13/303,285

(22) Filed: Nov. 23, 2011

(65) Prior Publication Data

US 2013/0126679 A1 May 23, 2013

(51) Int. Cl.
*G08B 21/00* (2006.01)
*G08G 5/00* (2006.01)

(52) U.S. Cl.
CPC ..... *G08G 5/0013* (2013.01); *G08G 5/0021* (2013.01); *G08G 5/0078* (2013.01); *G08G 5/0039* (2013.01); *G08G 5/0069* (2013.01); *G08G 5/0091* (2013.01)

(58) Field of Classification Search
CPC .. G08G 5/0013; G08G 5/0021; G08G 5/0078
USPC ..... 340/945–950, 972–973, 340/995.11–995.19, 961, 964, 953
See application file for complete search history.

(56) References Cited

U.S. PATENT DOCUMENTS 2,980,902 A * 4/1961 Tasker et al. ..... 342/34
3,940,597 A * 2/1976 DiMatteo ..... 701/518
4,274,096 A * 6/1981 Dennison ..... 342/456
4,706,198 A 11/1987 Thurman
5,381,338 A 1/1995 Wysocki et al.
5,554,990 A * 9/1996 McKinney ..... 342/36
5,890,079 A 3/1999 Levine
6,052,645 A * 4/2000 Harada ..... 701/423
6,057,786 A * 5/2000 Briffe et al. ..... 340/975
6,477,152 B1 * 11/2002 Hiett ..... 370/316
6,501,392 B2 * 12/2002 Gremmert et al. ..... 340/971
6,567,069 B1 * 5/2003 Bontrager et al. ..... 345/156
6,633,259 B1 * 10/2003 Smith et al. ..... 342/456
6,633,810 B1 * 10/2003 Qureshi et al. ..... 701/467

(Continued)

FOREIGN PATENT DOCUMENTS

WO WO 2004105340 A1 * 12/2004 ..... H04L 29/06
WO WO 2008126126 A2 * 10/2008 ..... G08G 5/00

OTHER PUBLICATIONS

Extended European Search Report of Application No. 12193473; Dec. 3, 2013; 8 pages.

(Continued)

*Primary Examiner* — Kerri McNally
(74) *Attorney, Agent, or Firm* — Armstrong Teasdale LLP

(57) ABSTRACT

A portable device for presenting situation awareness information is provided. The portable device is operable onboard an aircraft and includes a communications module configured to communicate with a data center to receive situation awareness information that includes at least a real-time position for each of a plurality of additional aircraft, a sensor module configured to determine a real-time position of the portable device, and a display device configured to overlay a moving map display with the situation awareness information and the real-time position of the portable device.

18 Claims, 4 Drawing Sheets

(56) References Cited

U.S. PATENT DOCUMENTS

| | | | | |
|---|---|---|---|---|
| 6,703,945 | B2 * | 3/2004 | Kuntman et al. | 340/961 |
| 6,795,408 | B1 * | 9/2004 | Hiett | 370/323 |
| 6,809,679 | B2 * | 10/2004 | LaFrey et al. | 342/37 |
| 7,090,128 | B2 * | 8/2006 | Farley et al. | 235/384 |
| 7,209,053 | B2 * | 4/2007 | Gannon | 340/972 |
| 7,212,917 | B2 | 5/2007 | Wilson, Jr. et al. | |
| 7,321,813 | B2 * | 1/2008 | Meunier | 701/10 |
| 7,330,780 | B2 | 2/2008 | Von Viebahn et al. | |
| 7,437,225 | B1 | 10/2008 | Rathinam | |
| 7,450,969 | B1 * | 11/2008 | Cockayne | 455/566 |
| 7,457,690 | B2 | 11/2008 | Wilson, Jr. et al. | |
| 7,633,428 | B1 | 12/2009 | McCusker et al. | |
| 7,859,433 | B2 * | 12/2010 | Barry et al. | 340/945 |
| 7,885,733 | B1 | 2/2011 | Simon | |
| 8,000,848 | B2 * | 8/2011 | Baranov et al. | 701/14 |
| 8,005,614 | B2 * | 8/2011 | Dattler et al. | 701/412 |
| 8,255,094 | B2 * | 8/2012 | Srinivasan et al. | 701/3 |
| 8,306,528 | B2 * | 11/2012 | Malosh | 455/431 |
| 8,452,475 | B1 * | 5/2013 | West et al. | 701/29.1 |
| 8,474,746 | B2 * | 7/2013 | van Helden | 244/25 |
| 8,509,140 | B2 * | 8/2013 | Kauffman | 370/316 |
| 8,515,600 | B1 * | 8/2013 | McCusker | 701/9 |
| 8,532,844 | B2 * | 9/2013 | Wilson et al. | 701/3 |
| 8,732,233 | B2 * | 5/2014 | Allen | 709/203 |
| 2002/0021247 | A1 * | 2/2002 | Smith et al. | 342/450 |
| 2002/0039072 | A1 * | 4/2002 | Gremmert et al. | 340/945 |
| 2002/0075171 | A1 * | 6/2002 | Kuntman et al. | 340/961 |
| 2003/0135327 | A1 | 7/2003 | Levine et al. | |
| 2004/0048598 | A1 * | 3/2004 | Gagnon | 455/404.2 |
| 2005/0051615 | A1 * | 3/2005 | Farley et al. | 235/375 |
| 2005/0270224 | A1 * | 12/2005 | Silberman et al. | 342/65 |
| 2006/0167598 | A1 * | 7/2006 | Pennarola | 701/11 |
| 2006/0227014 | A1 * | 10/2006 | Gannon | 340/972 |
| 2007/0005199 | A1 * | 1/2007 | He | 701/16 |
| 2007/0055416 | A1 * | 3/2007 | Allen | 701/3 |
| 2007/0120729 | A1 * | 5/2007 | Barry et al. | 342/33 |
| 2007/0186000 | A1 * | 8/2007 | Nikander et al. | 709/228 |
| 2007/0294064 | A1 * | 12/2007 | Shuster | 703/3 |
| 2008/0046141 | A1 * | 2/2008 | Dattler et al. | 701/29 |
| 2008/0228330 | A1 * | 9/2008 | Srinivasan et al. | 701/3 |
| 2009/0082954 | A1 * | 3/2009 | Ridenour, II | 701/206 |
| 2009/0109065 | A1 | 4/2009 | Pinheiro | |
| 2009/0125221 | A1 | 5/2009 | Estkowski et al. | |
| 2009/0231163 | A1 * | 9/2009 | He | 340/946 |
| 2009/0252372 | A1 * | 10/2009 | Davies | 382/100 |
| 2010/0030401 | A1 | 2/2010 | Rogers et al. | |
| 2010/0082184 | A1 | 4/2010 | Nichols et al. | |
| 2010/0102163 | A1 * | 4/2010 | Van Helden | 244/25 |
| 2010/0174475 | A1 | 7/2010 | Estkowski et al. | |
| 2010/0274468 | A1 * | 10/2010 | Durham et al. | 701/120 |
| 2012/0259549 | A1 * | 10/2012 | McDonald | 702/3 |
| 2013/0013134 | A1 * | 1/2013 | Lieu | 701/14 |
| 2013/0048782 | A1 * | 2/2013 | Bohlen et al. | 244/1 TD |

OTHER PUBLICATIONS

FAA Issues InFO Bulletin on Tablet EFB Authorization—Jeppesen Mobile TC for iPad Cited as Example; Jeppeseon—A Boeing Company; May 31, 2011; 2 pages.

Jeppeson Mobile FliteDecl—Frequently Asked Questions; Jeppeson—A Boeing Company; Aug. 18, 2011; 4 pages.

iCub—the LSA Bush Plane; http://icub.aero/?cat=14; accessed Nov. 11, 2011; 7 pages.

European Examination Report of Application No. 12193473.1, Feb. 9, 2015, 8 pages.

* cited by examiner

SYSTEM AND METHODS FOR SITUATION AWARENESS, ADVISORY, TRACKING, AND AIRCRAFT CONTROL INFORMATION

BACKGROUND

The field of the disclosure relates generally to situation awareness, advisory information, and aircraft control, and more specifically, to portable devices for processing and displaying, and acting on situation awareness information and advisory information.

Pilots use situation awareness information and advisory information when operating aircraft. Unmanned air systems (UAS) automated systems also utilize situation awareness and advisory information. Such information may include the position of the aircraft being operated, the position of additional aircraft, and/or advisory information. Situation awareness information may also include flight plan information, such as suggested routes, waypoints, etc.

At least some known situation awareness systems are fully integrated into their associated aircraft. That is, hardware for at least some situation awareness systems is permanently coupled to various aircraft systems and is mounted within the aircraft. Furthermore, given their complexity and permanent installation, at least some known situation awareness systems are relatively expensive.

Many pilots may be unable and/or unwilling to purchase expensive and cumbersome situation awareness systems. For example, general aviation pilots may be unable to afford situation awareness systems utilized by commercial and/or military pilots. Further, due to their configuration, certain types of aircraft, including but not limited to older aircraft, light sport, gliders, and balloons may be unable to support at least some known situation awareness systems.

At least some known portable devices are unable to display real-time positions of aircraft on moving map displays. Accordingly, at least some known portable devices are unable to present dynamic situation awareness information to a user. Further, at least some known devices that do provide moving map displays and information on traffic require transponder installation and are unable to provide over-the-horizon (non-local) traffic information or traffic flight plan information along an intended ownship route.

BRIEF DESCRIPTION

In one aspect, a portable device for presenting situation awareness information is provided. The portable device is operable onboard an aircraft and includes a communications module configured to communicate with a data center to receive situation awareness information that includes at least a real-time position for each of a plurality of additional aircraft, a sensor module configured to determine a real-time position of the portable device, and a display device configured to overlay a moving map display with the situation awareness information and the real-time position of the portable device.

In another aspect, a method for processing situation awareness information is provided. The method includes receiving, at a portable device operable onboard an aircraft, situation awareness information from a data center, the situation awareness information including at least a real-time position for each of a plurality of additional aircraft, determining a real-time position of the portable device, and displaying, on the portable device, a moving map overlaid with the situation awareness information and the real-time position of the portable device.

In yet another aspect, a method for transmitting a real-time position of an aircraft is provided. The method includes positioning a portable device onboard the aircraft, the portable device including a sensor module and a communications module, determining the real-time position of the aircraft using the sensor module, and transmitting the real-time position of the aircraft from the portable device to a data center using the communications module.

The features, functions, and advantages that have been discussed can be achieved independently in various embodiments or may be combined in yet other embodiments, further details of which can be seen with reference to the following description and drawings.

DETAILED DESCRIPTION

The systems and methods described herein facilitate processing and presenting dynamic situation awareness information. A portable device operable onboard an aircraft communicates with a data center to receive situation awareness information, such as the real-time position of other aircraft. The portable device also includes sensors for determining the real-time position of the portable device, and accordingly, the aircraft. The received situation awareness information and the real-time position of the aircraft may be displayed on the portable device. Further, the portable device may also be used to transmit situation awareness information to the data center, the situation awareness information gathered from one or more airborne sensors.

Figure 1:
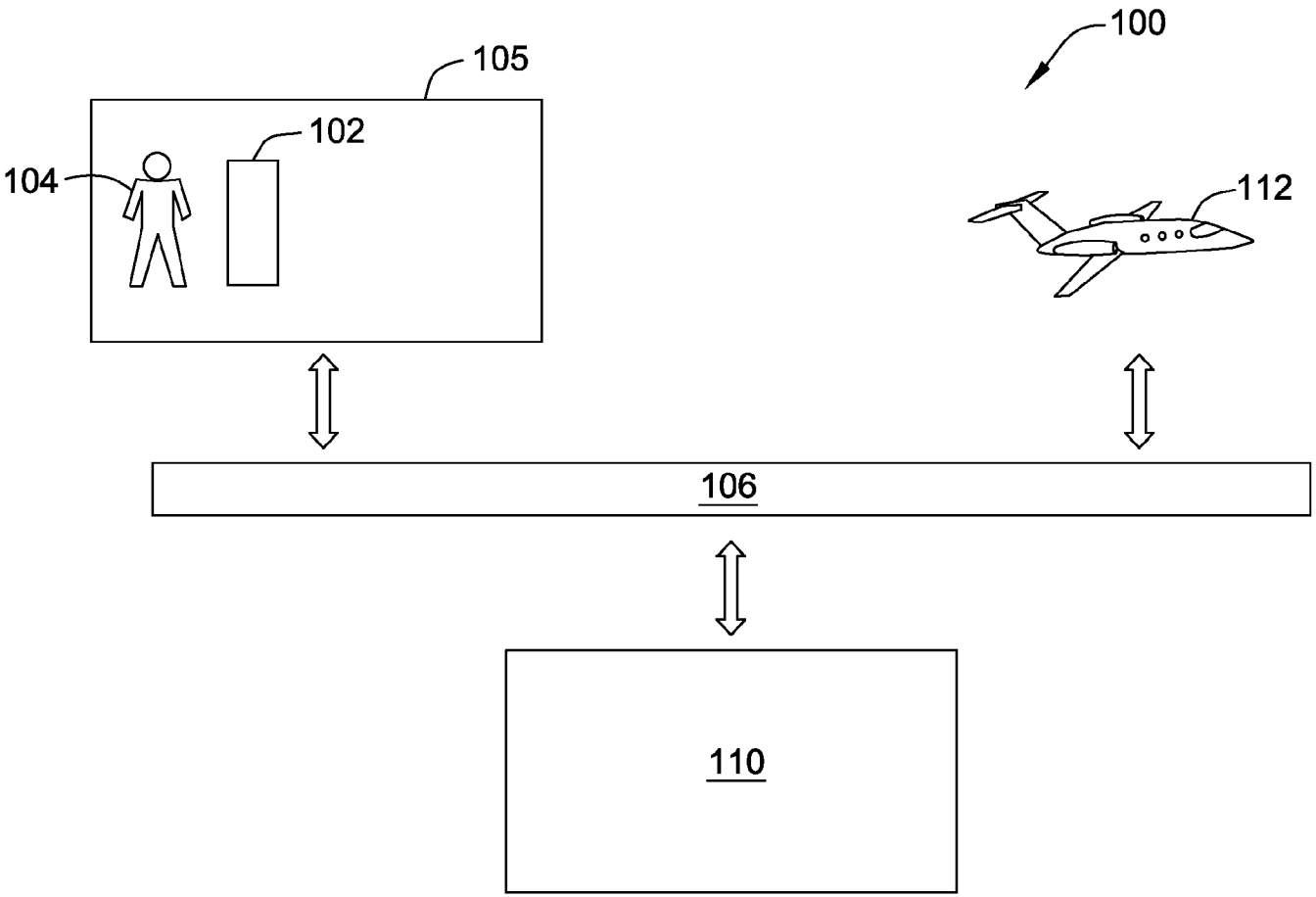
FIG. 1 is a schematic diagram of an exemplary situation awareness system.

FIG. 1 is a schematic diagram of an exemplary situation awareness system 100. System 100 includes a portable device 102 that receives and transmits situation awareness information, as described in detail below. A user 104 interacts with and/or operates portable device 102. As used herein, the term "situation awareness information" may include aircraft position information, flight plan information, weather information and/or advisories, and/or any other data that may be transmitted and/or received within system 100. Advisories may include, for example, restricted regions and/or routes, and/or suggested reroutes to avoid weather, traffic, and/or terrain.

In the exemplary embodiment, user 104 and portable device 102 are located onboard an aircraft 105. Alternatively, in embodiments where aircraft 105 is operated remotely, user 104 and/or portable device 102 may not be located onboard aircraft 105. Additionally, when aircraft 105 is operated remotely, portable device 102 may be onboard aircraft 105 and interface between a control center and an autopilot system of aircraft 105, as described in detail below. As used herein, the term "aircraft" includes airplanes, unmanned aerial vehicles (UAVs), missiles, ordinance, gliders, helicopters, balloons, and other objects that travel. For a UAV, in some embodiments, portable device 102 may be located at a UAV control station to provided additional and/or redundant situation awareness and/or control mechanisms.

To transmit and receive situation awareness information, portable device 102 communicates with other devices and/or systems over a communications link 106. In the exemplary embodiment, portable device 102 utilizes communications link 106 to communicate with a ground center 110 and other aircraft 112. Communications link 106 may include, but is not limited to, a wired and/or wireless network, a satellite network, radio, 3G, 4G, Controller Pilot Data Link Communications (CPDLC), and Tactical Digital Information Links (TADIL). In some embodiments, portable device 102 may communicate different types of data using different communication links 106. For example a 3G link may have a lower link latency, lower dropout rate, etc. In some embodiments, portable device 102 may also simultaneously communicate over multiple communication links 106 and/or to multiple receiving entities in order to improve communications reliability.

Ground center 110 functions as a data center for portable device 102 and may include an automated dynamic airspace control (ADAC) center, an air route traffic control center (ARTCC), an airport-based control tower, a terminal radar approach control (TRACON) center, and/or a flight service station (FSS). Alternatively, ground center 110 includes any control center that enables system 100 to function as described herein. Ground center 110 manages situation awareness information, generates trajectory predictions for aircraft 105 and 112, and generates and transmits reroute commands and/or advisories to aircraft 105 and 112. While in the exemplary embodiment, portable device 200 communicates with ground center 110, alternatively, portable device 200 communicates with any data center that enables system 100 to function as described herein. For example, portable device 200 may communicate with a data center onboard another aircraft, ship, or satellite, and/or distributed across multiple entities.

Figure 2:
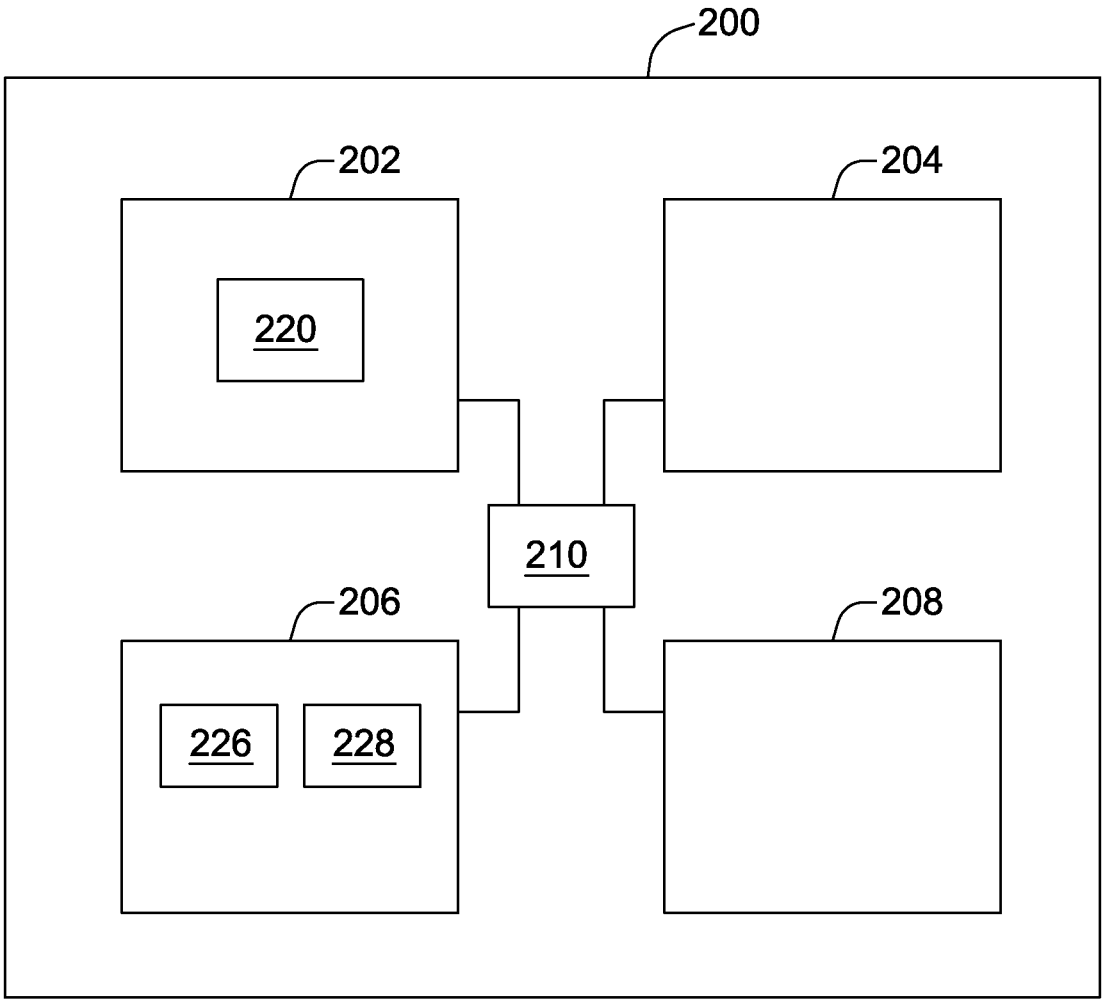
FIG. 2 is a block diagram of an exemplary portable device that may be used as part of the system shown in FIG. 1.

FIG. 2 is a block diagram of a portable device 200 that may be used as part of system 100 (shown in FIG. 1), such as portable device 102. In the exemplary embodiment, portable device 200 is a tablet computer. Alternatively, portable device 200 may be any portable device that enables system 100 to function as described herein. Portable device 200 includes a sensor module 202, a communications module 204, a user interface module 206, and an external device interface module 208. A processing module 210 is coupled to sensor module 202, communications module 204, user interface module 206, and external device interface module 208. Processing module 210 processes data for at least one of sensor module 202, communications module 204, user interface module 206, and external device interface module 208.

In the exemplary embodiment, sensor module 202 includes a global positioning system (GPS) sensor 220. GPS sensor 220 determines geopositional information for portable device 200, and accordingly, geopositional information for aircraft 105 when portable device 200 is onboard aircraft 105. Geopositional information may include, for example, the current latitude, longitude, and/or altitude of portable device 200. The geopositional information may be calculated, for example, by communicating with satellites using communications module 204. Based on the geopositional information, using processing module 210, portable device 200 may calculate a predicted trajectory for aircraft 105 that may be displayed on portable device 200 and/or transmitted to ground center 110 (shown in FIG. 1).

Sensor module 202 may also include additional sensors, such as a camera, a gyroscope, and altimeter, a barometer, an accelerometer, and/or any sensor that enables portable device 200 to function as described herein. In embodiments where sensor module 202 includes multiple sensors, portable device 200 may combine and analyze input from multiple sensors using, for example, processing module 210. Additionally, portable device may receive and/or process supplemental sensor data from external sensor modules.

Communications module 204 transmits and receives data for portable device 200. Using communications module 204, data may be transmitted and received from ground center 110 and other aircraft 112 for example, using communications link 106 (all shown in FIG. 1). Communications module 204 transmits and receives data using any suitable communications medium, including, but not limited to, a wired and/or wireless network, an Iridium satellite network, radio, 3G, Controller Pilot Data Link (CPDL), and Tactical Digital Information Links (TADIL). Moreover, in the exemplary embodiment, communications module 204 is capable of over-the-horizon communication of data. Further, communications module 204 is capable of communicating over multiple communications networks for an increased response time. Data transmitted and/or received by communications module 204 includes situation awareness information from ground center 110, geopositional information from GPS sensor 220, messages from user 104 input using user interface module 206, and/or any other types of data that enable portable device 200 to function as described herein. Communications module 204 may include an expanded data receiving capability, such as a stackable bus system, an expanded data processing capability, and/or an expanded data translation capability.

While in the exemplary embodiment, communications module 204 is part of portable device 200, alternatively, communications module 204 may be external to portable device 200. In embodiments where communications module 204 is external to portable device 200, communications module 204 and portable device 200 interface using any suitable medium including, but not limited to, a wireless network and/or a physical cable.

In the exemplary embodiment, communications module 204 transmits geopositional information from GPS sensor 220 to ground center 110. Geopositional information may be transmitted to ground center 110 continuously or periodically. The transmitted geopositional information provides basic tracking data for aircraft 105 to ground center 110. Ground center 110 can utilize the geopositional information to update situation awareness information, generate trajectory predictions for aircraft 105, and/or generate and transmit reroute commands to aircraft 105 and/or other aircraft 112. Accordingly, portable device 200 may provide tracking data to ground center 110 without the use of additional GPS or automatic dependent surveillance broadcast (ADS-B) systems.

Communications module 204 also receives situation awareness information from ground center 110 and/or other aircraft 112. In the exemplary embodiment, communications module 204 receives position and trajectory information for other aircraft 112. The received position and trajectory information may be displayed for user 104 using user interface module 206.

User interface module 206 includes an input device 226, such as a touchscreen, keypad and/or keyboard, and/or mouse that enables user 104 to enter information and interact with portable device 200. Using input device 226, user 104 can input one or more alerts. Such alerts may include weather advisories, flocks of birds, and/or the locations of thermals, turbulence, and/or control towers. Additionally, the alerting system may also serve as a timely incident reporting system. Using communications module 204, an input alert may be transmitted to ground center 110 for distribution to other aircraft 112. User 104 may also utilize user interface module 206 to input and send messages to an operator at ground center 110 regarding the status of aircraft 105. User 104 may also communicate information to any data processing center, control center, or aircraft owner entity that enables system 100 to function as described herein.

User interface module 206 also includes a display device 228 that enables user 104 to view situation awareness information. In the exemplary embodiment, display device 228 displays a moving map overlaid with dynamic situation awareness information. The moving map may include terrain data, elevation data, and/or any other information that enables display device 228 to function as described herein. Moreover, data associated with the moving map may be stored on portable device 200 and/or streamed and/or received from other sources. For example, map data may be received from ground center 110 using communications module 204. Portable device 200 receives situation awareness information from one or more source and displays the situation awareness information on display device 228.

In the exemplary embodiment, situation awareness information includes an own ship depiction that shows the real-time position of aircraft 105 on the moving map. Flight plan data for aircraft 105, such as waypoints and/or other symbols may be shown on display device 228. A depiction and position of other aircraft, such as aircraft 112 may also be shown on display device 228. Situation awareness displayed on display device 228 may include any other information that enables portable device 200 to function as described herein. For example, information associated with weather advisories, flocks of birds, and/or the locations of thermals, turbulence, and/or control towers may be displayed on display device 228.

In the exemplary embodiment, portable device 200 determines the real-time position of aircraft 105 using GPS module 220. Alternatively, portable device 200 may interface with one or more external devices to determine the real-time position of aircraft 105. For example, portable device 200 may interface with an external GPS device onboard aircraft 105.

Flight plan data for aircraft 105 may be stored on portable device 200, or may be received from ground center 110 via communications module 204. If ground center 110 transmits one or more reroute commands to portable device 200, the flight plan data shown on display device 228 is updated accordingly. For example, after a reroute command is received from ground center 110, updated waypoints may be shown on display device 228. Portable device 200 may also verify the validity, safety, and/or feasibility of a reroute command received from ground center 110 using processing module 210. Moreover, in some embodiments, a plurality of route options and information associated with each route option (e.g., time, distance, fuel requirements, etc.) may be shown on display device 228.

Portable device determines the real-time position of other aircraft 112 by communicating with ground center 110 using communications module 204 in the exemplary embodiment. That is, other aircraft 112 transmit associated real-time position information to ground center 110, which in turn relays the information to portable device 200. Alternatively, portable device 200 may determine the real-time position of other aircraft 112 by communicating directly with other aircraft 112.

External device interface module 208 enables portable device 200 to interface and/or communicate with one or more external devices (not shown) onboard aircraft 105. Such external devices include, but are not limited to, an autopilot system, an air data system, a satellite modem, a GPS device, a cellular modem, a radio, a sensor system, a radar system, and/or an ADS-B system. Accordingly, in some embodiments, portable device 200 may receive information from such external devices.

In order to interface with the external devices, external device interface module 208 includes suitable hardware, such as converters and/or adaptors. For example, in one embodiment, external device interface module 208 includes a serial adaptor and a wireless network adaptor. While in the exemplary embodiment, external device interface module 208 is separate from communications module 204, in some embodiments, external device interface module 208 is part of communications module 204. Further, in some embodiments, external device interface module 208 is a separate component from portable device 200.

Using external device interface module 208, portable device 200 may interface directly with an autopilot system to control aircraft 105. Specifically, flight plan data for aircraft 105 may be stored and/or received at portable device 200, as described above. Portable device 200 supplies the received flight plan data to the autopilot system, and the autopilot system utilizes the flight plan data to perform control maneuvers to control flight of aircraft 105. To interface directly with the autopilot system, portable device 200 may interface directly with a bus on which the autopilot system is directly connected. Alternatively, portable device 200 may have a direct digital and/or analog connection to an autopilot and/or steering/control system that is not connected to a bus.

As such, in some embodiments, portable device 200 may be used in conjunction with an unmanned aerial vehicle (UAV) to receive flight plan information and pilot the UAV in accordance with the flight plan information. Furthermore, in some embodiments, communications module 204 may be configured to receive routing commands from a data center, such as ground center 110, and external device interface module 208 is further configured to supply routing commands to the autopilot system. In many embodiments, communications module 204 is further configured to receive routing commands from the data center, and display device 228 is further configured to update one or more displayed waypoints based on the routing commands. In some embodiments, portable device 200 receives routing commands from the data center and supplies the routing commands to the autopilot system of aircraft 105, and portable device is located onboard an unmanned aerial vehicle. Accordingly, portable device 200 may operate with or without user 104 onboard aircraft 105.

Figure 3:
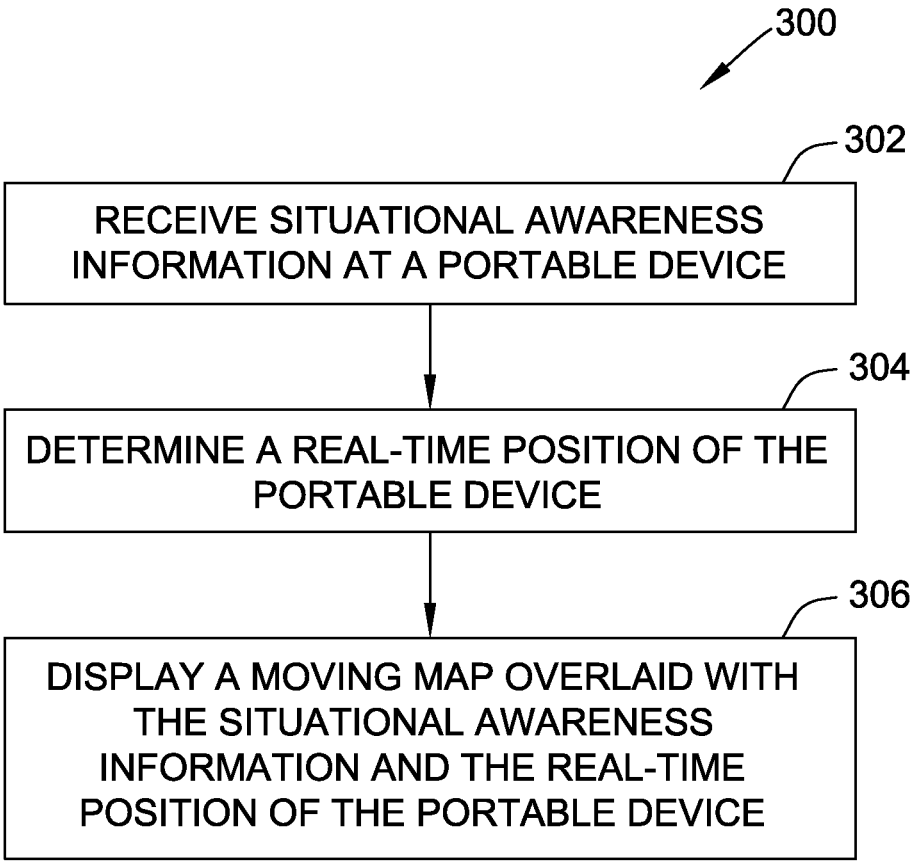
FIG. 3 is a flowchart of an exemplary method for processing situation awareness information that may be used with the system shown in FIG. 1.

FIG. 3 is a flowchart of an exemplary method 300 for processing situation awareness information that may be used with system 100 (shown in FIG. 1). Method 300 includes receiving 302 situation awareness information at a portable device, such as portable device 200 (shown in FIG. 2). The portable device is located onboard an aircraft, such as aircraft 105 (shown in FIG. 1). Moreover, the situation awareness information includes at least a real-time position of a plurality of aircraft, such as other aircraft 112 (shown in FIG. 1).

Method 300 further includes determining 304 a real-time position of the portable device. As the portable device is located onboard the aircraft, the real-time position of the portable device corresponds to the real-time position of the aircraft. The real-time position of the portable device may be determined using, for example, a GPS sensor, such as GPS sensor 220 (shown in FIG. 2).

A moving map is displayed 306 on a display device, such as display device 228 (shown in FIG. 2). The moving map is overlaid with the situation awareness information and the real-time position of the portable device. Accordingly, a user, such as user 104, may use the portable device to view a real-time position of the aircraft on which the portable device is located, as well as a real-time position of other aircraft.

Figure 4:
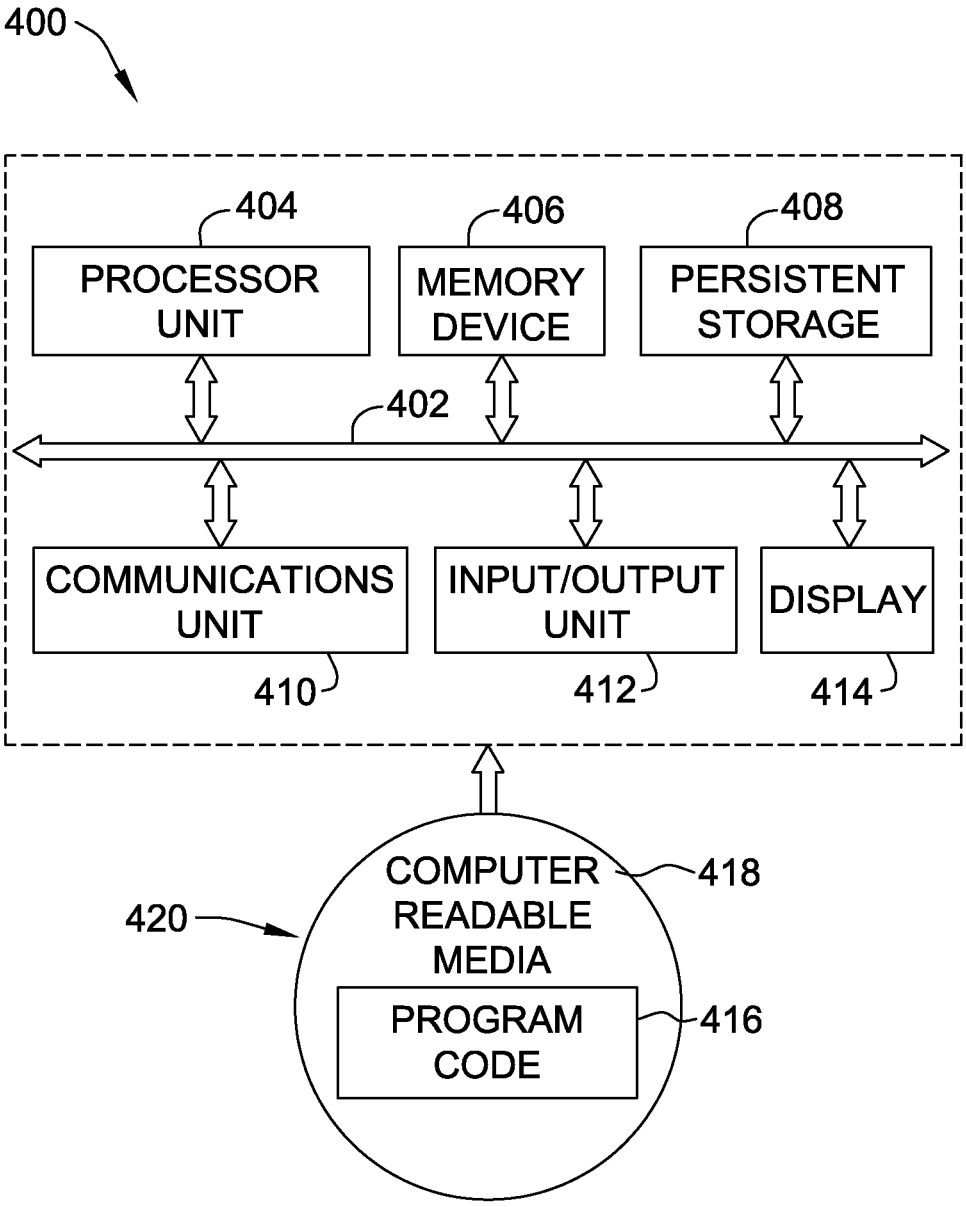
FIG. 4 is a diagram of an exemplary data processing system.

FIG. 4 is a diagram of an exemplary data processing system 400 that may be used in implementing one or more of the embodiments described herein. For example, portable device 200, sensor module 202, communications module 204, user interface module 206, external device interface module 208, and/or processing module 210 may be implemented using data processing system 400. In the exemplary embodiment, data processing system 400 includes communications fabric 402, which provides communications between processor unit 404, memory 406, persistent storage 408, communications unit 410, input/output (I/O) unit 412, and display 414.

Processor unit 404 serves to execute instructions for software that may be loaded into memory 406. Processor unit 404 may be a set of one or more processors or may be a multiprocessor core, depending on the particular implementation. Further, processor unit 404 may be implemented using one or more heterogeneous processor systems in which a main processor is present with secondary processors on a single chip.

As another illustrative example, processor unit 404 may be a symmetric multi-processor system containing multiple processors of the same type. Further, processor unit 404 may be implemented using any suitable programmable circuit including one or more systems and microcontrollers, microprocessors, reduced instruction set circuits (RISC), application specific integrated circuits (ASIC), programmable logic circuits, field programmable gate arrays (FPGA), and any other circuit capable of executing the functions described herein.

Memory 406 and persistent storage 408 are examples of storage devices. A storage device is any piece of hardware that is capable of storing information either on a temporary basis and/or a permanent basis. Memory 406, in these examples, may be, for example, without limitation, a random access memory or any other suitable volatile or non-volatile storage device. Persistent storage 408 may take various forms depending on the particular implementation.

For example, without limitation, persistent storage 408 may contain one or more components or devices. For example, persistent storage 408 may be a hard drive, a flash memory, a rewritable optical disk, a rewritable magnetic tape, or some combination of the above. The media used by persistent storage 408 also may be removable. For example, without limitation, a removable hard drive may be used for persistent storage 408. Persistent storage 408 may also include so-called "cloud" storage.

Communications unit 410, in these examples, provides for communications with other data processing systems or devices. In these examples, communications unit 410 is a network interface card. Communications unit 410 may provide communications through the use of either or both physical and wireless communication links.

Input/output unit 412 allows for input and output of data with other devices that may be connected to data processing system 400. For example, without limitation, input/output unit 412 may provide a connection for user input through a keyboard and mouse. Further, input/output unit 412 may send output to a printer. Display 414 provides a mechanism to display information to a user.

Instructions for the operating system and applications or programs are located on persistent storage 408. These instructions may be loaded into memory 406 for execution by processor unit 404. The processes of the different embodiments may be performed by processor unit 404 using computer implemented instructions, which may be located in a memory, such as memory 406. These instructions are referred to as program code, computer usable program code, or computer readable program code that may be read and executed by a processor in processor unit 404. The program code in the different embodiments may be embodied on different physical or tangible computer readable media, such as memory 406 or persistent storage 408.

Program code 416 is located in a functional form on computer readable media 418 that is selectively removable and may be loaded onto or transferred to data processing system 400 for execution by processor unit 404. Program code 416 and computer readable media 418 form computer program product 420 in these examples. In one example, computer readable media 418 may be in a tangible form, such as, for example, an optical or magnetic disc that is inserted or placed into a drive or other device that is part of persistent storage 408 for transfer onto a storage device, such as a hard drive that is part of persistent storage 408. In a tangible form, computer readable media 418 also may take the form of a persistent storage, such as a hard drive, a thumb drive, or a flash memory that is connected to data processing system 400. The tangible form of computer readable media 418 is also referred to as computer recordable storage media. In some instances, computer readable media 418 may not be removable.

Alternatively, program code 416 may be transferred to data processing system 400 from computer readable media 418 through a communications link to communications unit 410 and/or through a connection to input/output unit 412. The communications link and/or the connection may be physical or wireless in the illustrative examples. The computer readable media also may take the form of non-tangible media, such as communications links or wireless transmissions containing the program code.

In some illustrative embodiments, program code 416 may be downloaded over a network to persistent storage 408 from another device or data processing system for use within data processing system 400. For instance, program code stored in a computer readable storage medium in a server data processing system may be downloaded over a network from the server to data processing system 400. The data processing system providing program code 416 may be a server computer, a client computer, or some other device capable of storing and transmitting program code 416.

The different components illustrated for data processing system 400 are not meant to provide architectural limitations to the manner in which different embodiments may be implemented. The different illustrative embodiments may be implemented in a data processing system including components in addition to or in place of those illustrated for data processing system 400. Other components shown in FIG. 4 can be varied from the illustrative examples shown.

As one example, a storage device in data processing system 400 is any hardware apparatus that may store data. Memory 406, persistent storage 408 and computer readable media 418 are examples of storage devices in a tangible form.

In another example, a bus system may be used to implement communications fabric 402 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, without limitation, memory 406 or a cache such as that found in an interface and memory controller hub that may be present in communications fabric 402.

The embodiments described herein facilitate processing and presenting dynamic situation awareness information. A portable device operable onboard an aircraft communicates with a data center to receive situation awareness information, such as the real-time position of other aircraft. The portable device also includes sensors for determining the real-time position of the portable device, and accordingly, the aircraft. The received situation awareness information and the real-time position of the aircraft may be displayed on the portable device. Further, the portable device may also be used to transmit situation awareness information to the data center, the situation awareness information gathered from one or more airborne sensors.

The systems and methods described herein prove a pilot and/or autopilot of an aircraft with real-time, in-flight, and/or over-the-horizon situation awareness information and advisory information, such as, for example, traffic safety advisory information. Further, the systems and methods described herein may be implemented using existing network technology. Moreover, the embodiments described herein may be implemented using relatively inexpensive portable devices, such as, for example, tablet computers and/or smart phones.

Unlike at least some known situation awareness systems and methods, because the systems and methods described herein utilize a portable device, the systems and methods described herein are relatively inexpensive and accessible. Furthermore, unlike at least some known situation awareness systems, the portable device need not be permanently installed within an aircraft. Further, the portable device may be utilized to process and present situation awareness information for aircraft that are unable to support at least some known situation awareness systems. Moreover, unlike at least some known portable device, the described systems utilize networked information instead of solely relying on local information obtained from line-of-site short-range sensors and transponders.

The embodiments described herein may utilize executable instructions embodied in a computer readable medium, including, without limitation, a storage device or a memory area of a computing device. Such instructions, when executed by one or more processors, cause the processor(s) to perform at least a portion of the methods described herein. As used herein, a "storage device" is a tangible article, such as a hard drive, a solid state memory device, and/or an optical disk that is operable to store data.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A portable device for presenting situation awareness information, said portable device operable onboard an aircraft and comprising:

a communications module configured to communicate with a data center to receive situation awareness information and routing commands from the data center, wherein the situation awareness information includes at least a real-time position for each of a plurality of additional aircraft;

an external device interface module configured to supply the routing commands received from the data center to an autopilot system of the aircraft;

a sensor module configured to determine a real-time position of said portable device; and a display device configured to overlay a moving map display with the situation awareness information and the real-time position of said portable device, wherein said portable device is a tablet computer.

2. A portable device in accordance with claim 1, wherein said portable device is located onboard an unmanned aerial vehicle.

3. A portable device in accordance with claim 1, wherein said situation awareness information includes at least one of an advisory, a warning, and a route command.

4. A portable device in accordance with claim 1, wherein said portable device further comprises a user interface module configured to receive at least one alert from a user.

5. A portable device in accordance with claim 1, wherein said communications module is configured to receive situation awareness information that includes weather advisories, and wherein said display device is configured to display received weather advisories.

6. A portable device in accordance with claim 1, wherein said communications module is further configured to transmit the real-time position of said portable device to the data center, and wherein the data center is one of an automated dynamic airspace control center, an air route traffic control center, an airport-based control tower, a terminal radar approach control system, or a flight service station.

7. A portable device in accordance with claim 1, wherein said display device is further configured to display a plurality of waypoints corresponding to a flight plan of the aircraft.

8. A portable device in accordance with claim 7, wherein said display device is further configured to update the displayed plurality of waypoints based on the routing commands received from the data center.

9. A method for processing situation awareness information, said method comprising:

receiving, at a portable device operable onboard an aircraft, situation awareness information and routing commands from a data center, the situation awareness information including at least a real-time position for each of a plurality of additional aircraft;

supplying the routing commands received from the data center to an autopilot system of the aircraft;

determining a real-time position of the portable device; and displaying, on the portable device, a moving map overlaid with the situation awareness information and the real-time position of the portable device, wherein the portable device is a tablet computer.

10. A method in accordance with claim 9, further comprising:

verifying, at the portable device, the validity of the routing commands, wherein the portable device is located onboard an unmanned aerial vehicle.

11. A method in accordance with claim 9, wherein determining a real-time position of the portable device comprises determining the real-time position of the portable device using a global positioning system sensor.

12. A method in accordance with claim 9, wherein receiving situation awareness information comprises receiving situation awareness information that includes locations of at least one of flocks of birds, thermals, turbulence, and control towers.

13. A method in accordance with claim 9, further comprising displaying, on the portable device, a plurality of waypoints corresponding to a flight plan of the aircraft.

14. A method in accordance with claim 13, further comprising:

updating the displayed plurality of waypoints based on the routing commands, wherein the data center is located onboard another aircraft.

15. A method for transmitting a real-time position of an aircraft comprising:

positioning a portable device onboard the aircraft, the portable device including a sensor module and a communications module;

determining the real-time position of the aircraft using the sensor module;

transmitting the real-time position of the aircraft from the portable device to a data center using the communications module, wherein the portable device is a tablet computer;

receiving, at the portable device, routing commands from the data center; and supplying the routing commands received from the data center to an autopilot system of the aircraft.

16. A method in accordance with claim 15, further comprising:

receiving, at the portable device, situation awareness information from a user onboard the aircraft; and transmitting the situation awareness information from the portable device to the data center using the communications module.

17. A method in accordance with claim 15, wherein receiving situation awareness information comprises receiving one or more alerts.

18. A method in accordance with claim 15, wherein determining the real-time position of the aircraft comprises determining a real-time position of the portable device using a global positioning system sensor.

* * * * *